United States Patent [19]

Garland

[11] Patent Number: 5,037,035

[45] Date of Patent: Aug. 6, 1991

[54] MACHINE FOR COMMINUTING MATERIALS

[75] Inventor: Paul A. Garland, North Yorks, England

[73] Assignee: Impact Technology Limited, England

[21] Appl. No.: 401,440

[22] PCT Filed: Nov. 17, 1988

[86] PCT No.: PCT/GB88/01011

§ 371 Date: Sep. 8, 1989

§ 102(e) Date: Sep. 8, 1989

[87] PCT Pub. No.: WO89/04720

PCT Pub. Date: Jun. 1, 1989

[30] Foreign Application Priority Data

Nov. 20, 1987 [GB] United Kingdom ..... 8727231

[51] Int. Cl.[5] ..... B02C 19/00

[52] U.S. Cl. ..... 241/275

[58] Field of Search ..... 241/5, 275, 300

[56] References Cited

U.S. PATENT DOCUMENTS

| | | | |
|---|---|---|---|
| 3,544,014 | 12/1970 | Kampe | 241/275 X |
| 3,767,127 | 10/1973 | Wood | 241/275 |
| 4,738,403 | 4/1988 | Sevelinge | 241/275 |
| 4,784,339 | 11/1988 | Deffenbaugh | 241/275 |

FOREIGN PATENT DOCUMENTS

| | | | |
|---|---|---|---|
| 2351491 | 4/1975 | Fed. Rep. of Germany | 241/275 |
| 2092916 | 8/1982 | United Kingdom . | |

*Primary Examiner*—Mark Rosenbaum

*Attorney, Agent, or Firm*—Darby & Darby

[57] ABSTRACT

A machine for comminuting material by impact, comprising a hollow impeller rotatable about a substantially vertical axis, an upwardly opening material inlet and radially outward material outlet ducts (40). The ducts (40) are sufficiently narrow to prevent material striking the walls thereof with a high impact force. A plurality of anvils are arranged to be struck by material which has emerged from the ducts (40). One side wall of each duct (40) is lined with a tile (55) of a ceramic material such as aluminum oxide.

8 Claims, 4 Drawing Sheets

MACHINE FOR COMMINUTING MATERIALS

This invention relates to a machine for comminuting materials.

GB-A-2092916 describes a machine for comminuting materials which is in the form of an impact breaker, that is to say, a machine for comminuting brittle materials by the dissipation of kinetic energy impact. The machine described in GB-A-2092916 comprises a hollow impeller rotatable about substantially vertical axis and having interior walls, an upwardly opening material inlet and at least one radially outward material outlet. Means are provided for feeding the material to be comminuted into the material inlet, the feeding means comprising an upper stationary portion and a lower portion which is rotatable to impart to the material being fed an angular velocity about an axis substantially coincident with the axis of rotation of the impeller. The feeding means is so dimensioned as to cause material fed therethrough to be in a choked condition when the lower portion is rotating. At least one anvil is arranged to be struck by material which has emerged from the material outlet or outlets after travelling along at least a portion of the interior walls of the impeller.

As the material to be comminuted travels through the radially outward material outlet or outlets, the walls thereof are subject to wear, and, accordingly, those walls are lined with materials which are abrasion resistant. This abrasion resistant material is provided in the form of removable components which can be replaced as and when excessive wear has occurred. The replacement of these wear parts can constitute a very significant portion of the cost of operating the impact breaker, depending on the nature of the material being comminuted, besides which it is inconvenient to have to stop the machine frequently to change the wear parts. It is therefore desirable to be able to use for these wear parts materials having the highest abrasion resistance possible.

From the point of view of resistance to abrasion the best materials currently available are certain ceramics. Setting aside some, for example tungsten carbide, which are extremely expensive, the most useful materials as regards abrasion resistance include aluminium oxide and silicon carbide. However, these materials are very brittle, and can therefore only be used where the maximum impact force to which they are liable to be subjected is sufficiently low not to cause them to fracture. It is an object of the present invention to provide a machine for comminuting material by impact, the design of which is such that brittle materials can be used for the wear parts mentioned above.

According to the present invention there is provided a machine for comminuting material by impact, comprising a hollow impeller rotatable about a substantially vertical axis an upwardly opening material inlet and at least one radially outward material outlet duct, the or each said duct being sufficiently narrow to prevent material striking the walls thereof with a high impact force; and at least one anvil arranged to be struck by material which has emerged from the said at least one duct.

An embodiment of the present invention is shown in the accompanying drawings, in which.

Figure 1:
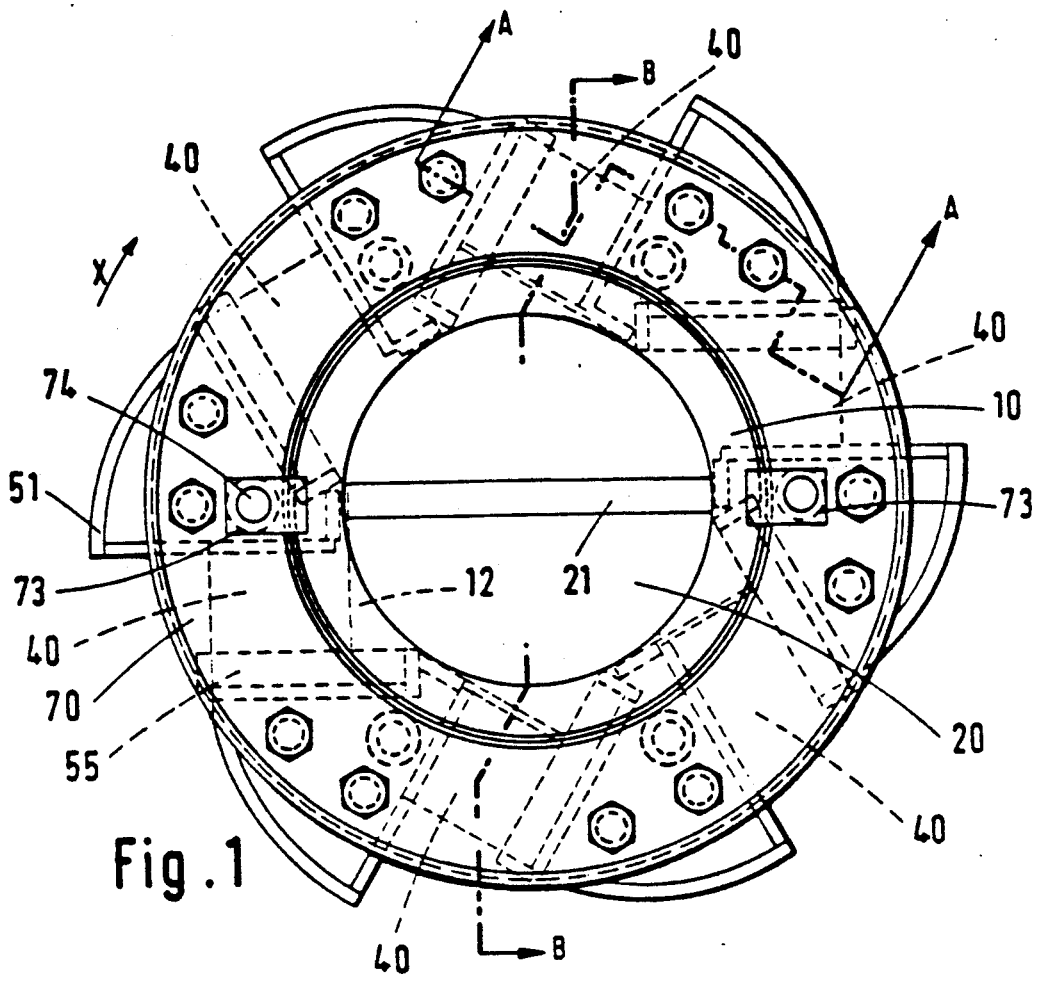
FIG. 1 is a plan view of an impeller forming part of the machine according to the present invention.
Figure 4A:
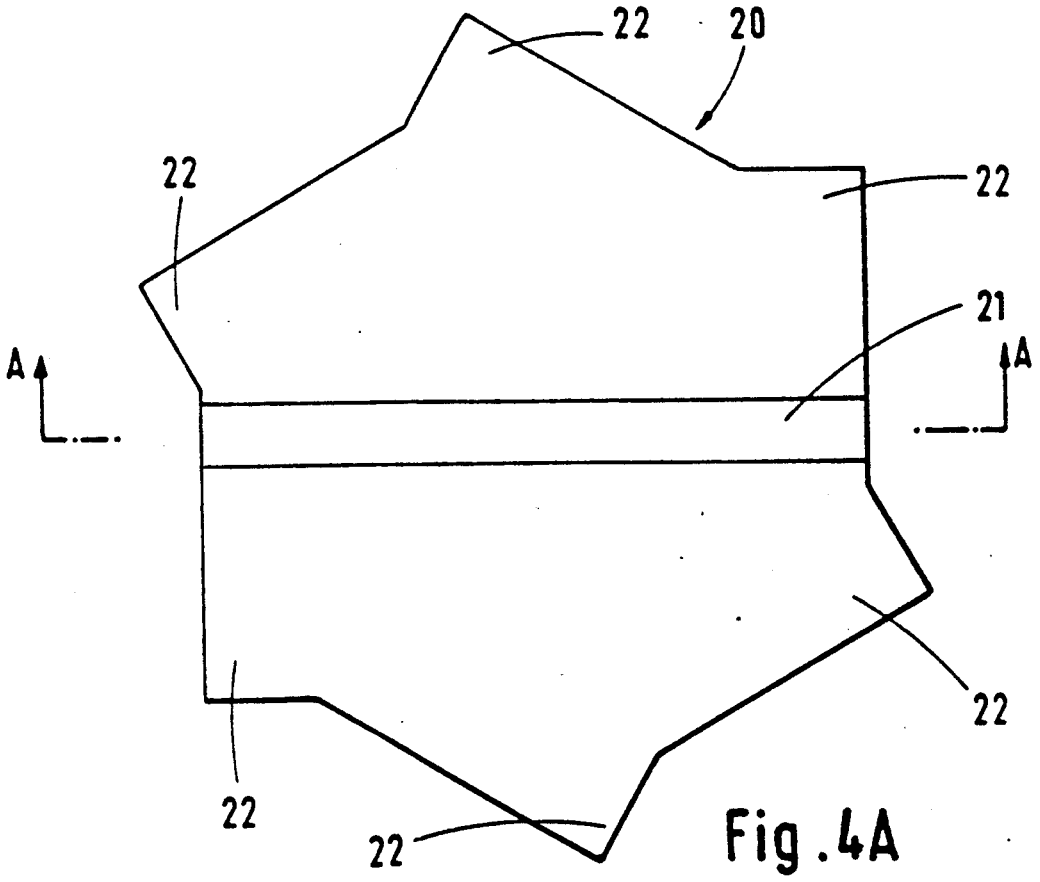
Figure 4B:
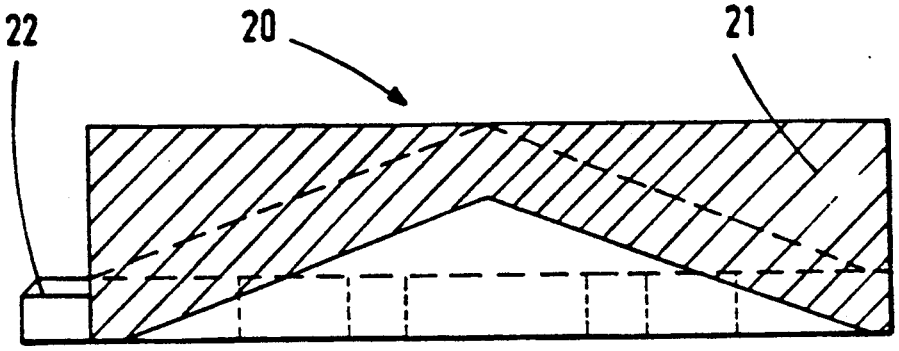
Figure 5:
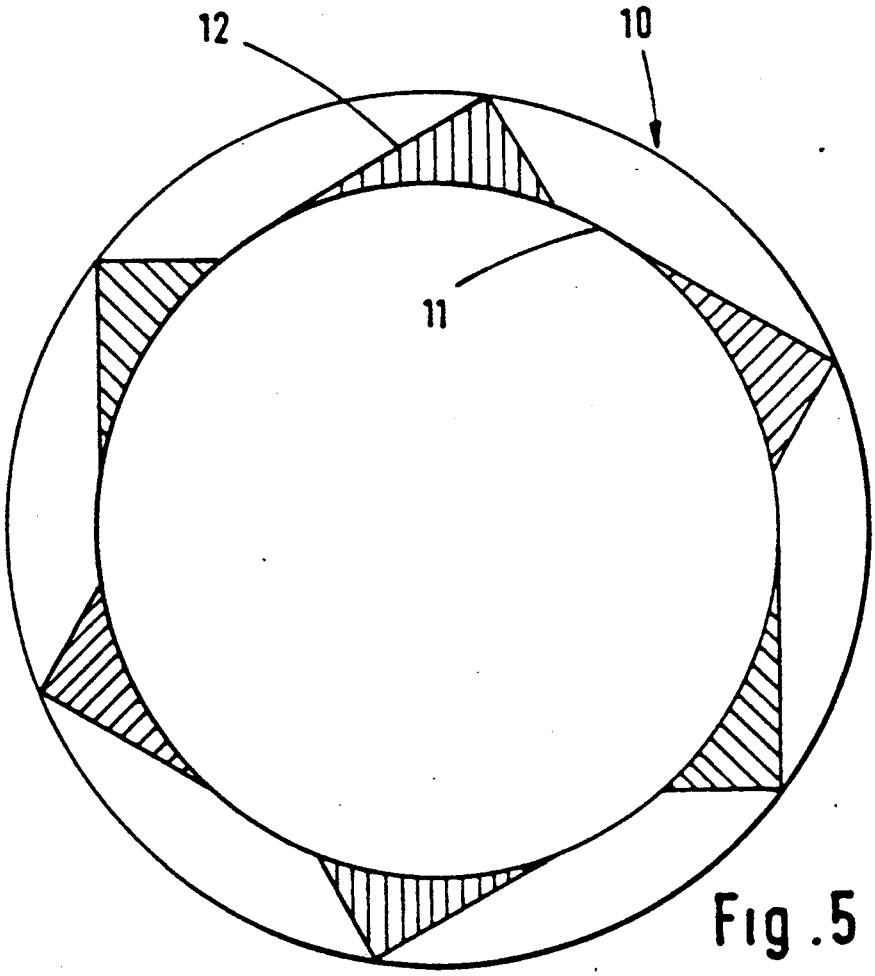
Figure 6:
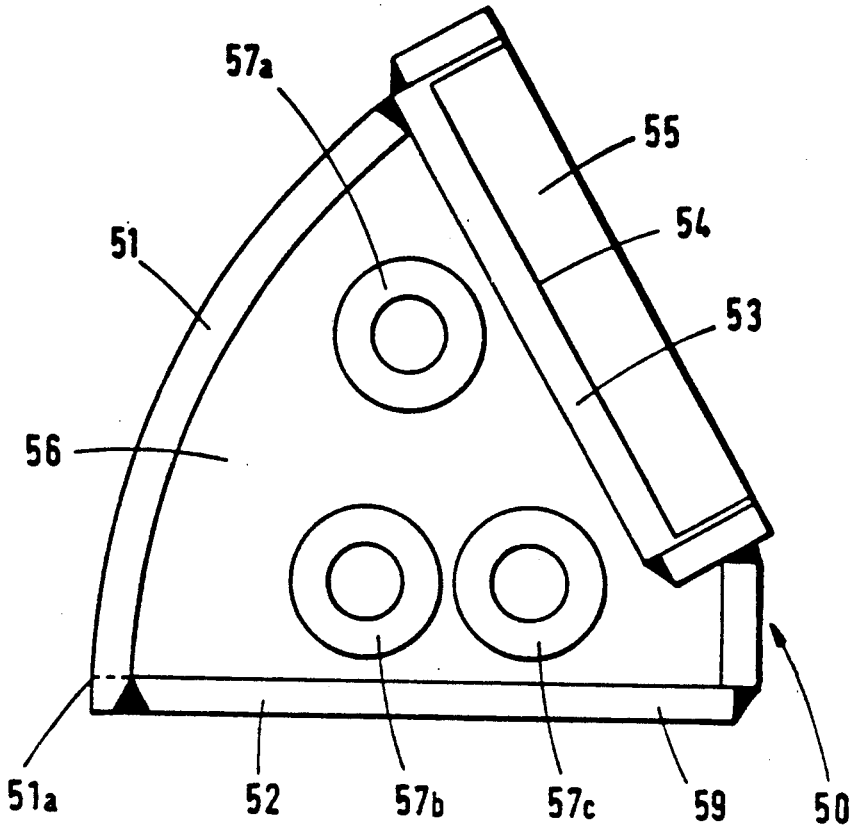
Figure 7:
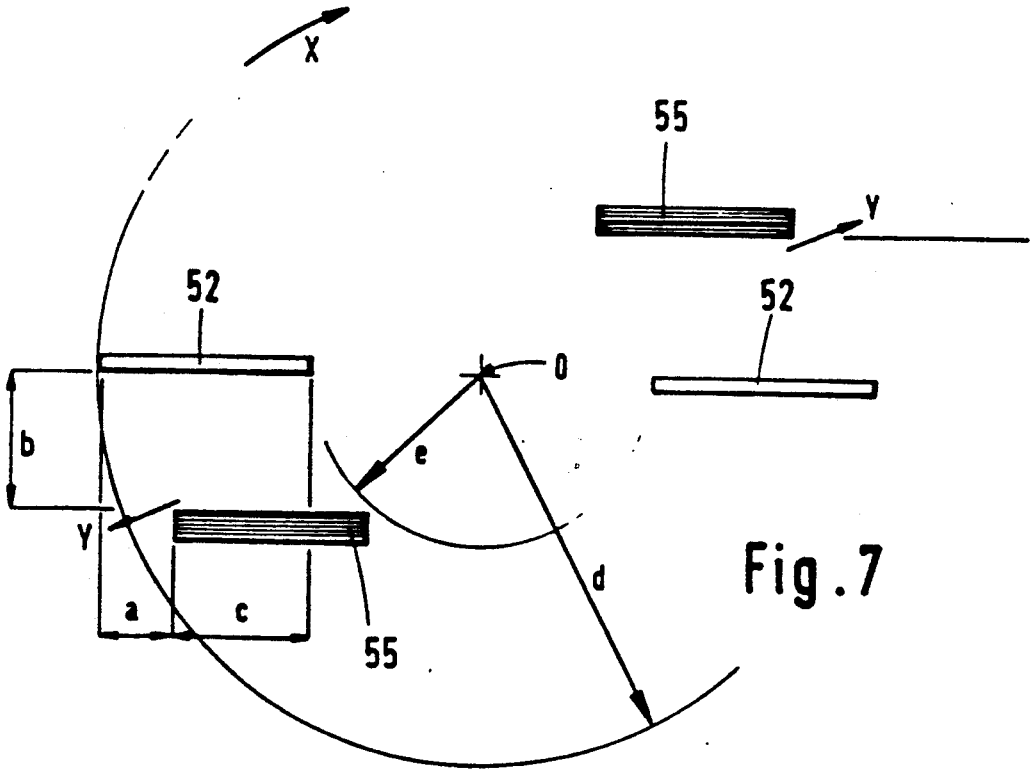

FIG. 4*a* and 4*b* are a plan view, and a section on line A—A in FIG. 4*a* respectively, of an accelerator plate forming part of the impeller of FIG. 1;

FIG. 5 is an underplan view of a rotatable ring forming part of the machine according to the present invention;

FIG. 6 is a plan view of a wear part carrier forming part of the machine according to the present invention; and FIG. 7 is a diagrammatic view of part of what is shown in FIG. 1, with various dimensions indicated, with reference to which the dimensions of the impeller are discussed below.

Figure 3:
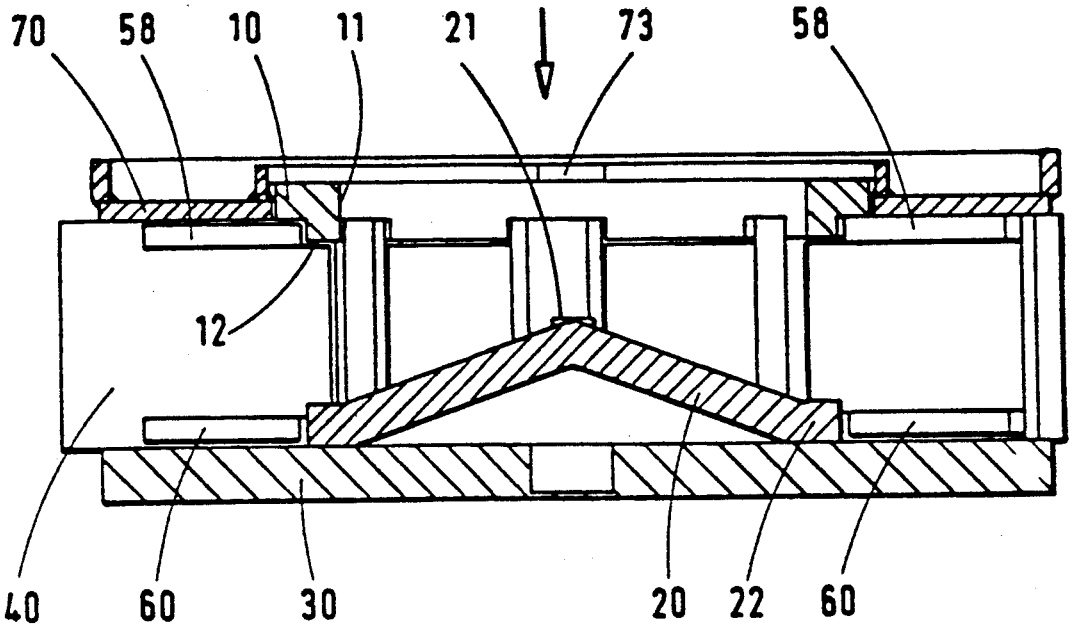
FIG. 3 is a section taken on line B—B in FIG. 1, also on a larger scale.

The impeller illustrated in the drawings is rotated about its vertical axis, and material to be comminuted is fed into the impeller from above, i.e. in the direction of the arrow shown in FIG. 3. The material is fed into the impeller through a feed tube (not shown) the external diameter of which is just less than the internal diameter of the first impeller component which the material encounters, namely a ring 10. The inner peripheral wall 11 of the ring 10 is partially obscured by the downstream end portion of the feed tube. The feed tube is arranged to be axially adjustable with respect to the ring 10, so that the extent to which the peripheral wall 11 is exposed to the material be fed into the impeller can be adjusted. This enables the feed conditions to be adjusted to suit the material concerned. The feed tube and ring 10 cooperate to provide a condition of choked feed, a condition which is explained in more detail in GB-A-2092916. As can be seen from FIG. 5, the ring 10 has on its lower surface six regions 12 of generally triangular shape where the surface is hardened. The reason for the presence of the regions 12 is explained below.

Material entering the impeller has some angular momentum imparted to it by the ring 10. It then falls onto an accelerator plate 20 which has the general shape of a shallow, upwardly pointing cone, with a cone angle of about 140°. In the illustrated embodiment the accelerator plate 20 has a vertically extending rib 21 running diametrically across it. Depending on the type of material to be comminuted this rib may or may not be provided. For example, in the case of material which enters the impeller in the form of large diameter lumps it is preferable for the rib 21 to be absent. As seen in plan view (FIG. 4*a*) the accelerator plate 20 has six generally triangular projections 22 spaced about its circumference. The accelerator plate 20 rests on a base plate 30 which forms the lower end of the impeller.

The outer annular region of the impeller defines a plurality of ducts 40, in this case six such ducts, through which material is impelled by the accelerator plate 20 in a radially outward direction. An annular array of stationary anvils is disposed around the outside of the impeller, and material passes radially outwardly through the ducts and strikes the anvils at high speed, thus comminuting the material. The array of anvils can be of basically conventional form, and is therefore not shown further here.

Figure 2:
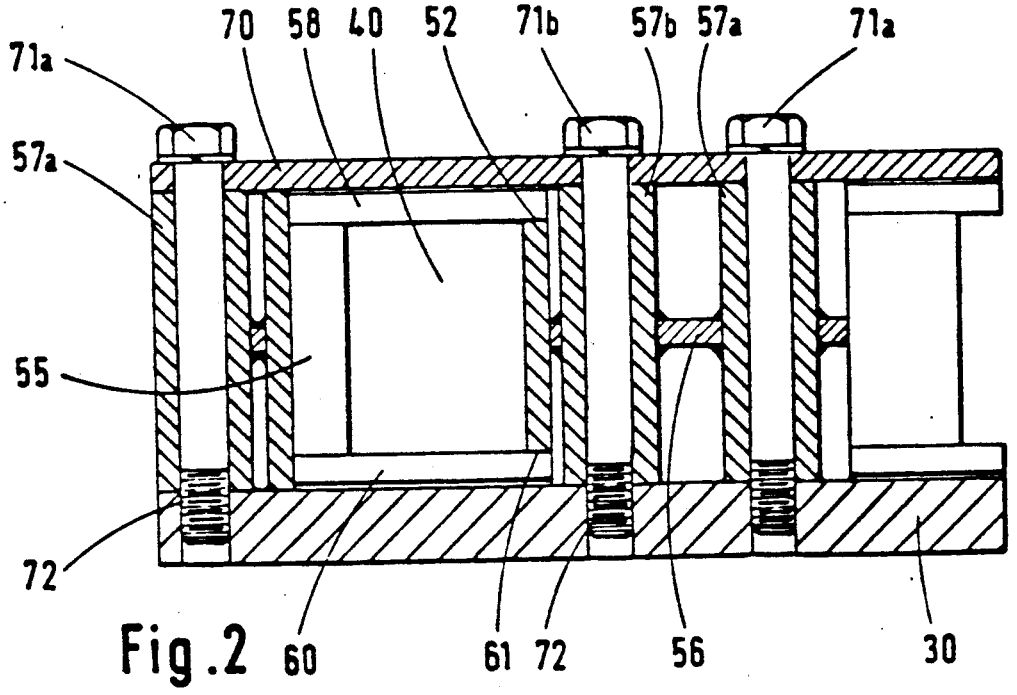
FIG. 2 is a section taken along line A—A in FIG. 1, on a larger scale.

The ducts 40 are defined in part by six wear part carriers 50, one of which is shown in plan view in FIG. 6. Each wear part carrier 50 is approximately arcuate in plan view, with a curved radially outer wall 51 a straight side wall 52 and a third wall 53 which defines a recess 54 in which is received a rectangular tile 55 of a ceramic material such as aluminium oxide. The walls 51,52 and 53 are interconnected by a transverse web 56 which can be seen most clearly in FIG. 2. Extending from top to bottom of the wear part carrier, through the web 56, are three cylindrical shafts 57*a*, 57*b* and 57*c*. As will be explained below, the shaft 57*c* is needed on only two out of the six wear part carriers, but for convenience of manufacture all wear part carriers are made of the same construction and hence all include the three shafts.

The outer surface of each ceramic tile 55 defines one side wall of a respective duct 40. The opposite side wall is provided by the outer face of the straight wall 52 of an adjacent wear part carrier. The top wall of each duct 40 is provided by a ceramic tile 58 of a material such as aluminium oxide, one edge of which rests on a respective tile 55 and the other edge of which rests in a recess 59 provided in the upper edge of the wall 52 of a respective wear part carrier. The tiles 58 are rectangular, and this leaves approximately triangle portions of the upper wall of each duct at its radially inner end to be provided by the underside of the ring 10. It is for this reason that the hardened portions 12 are provided, since it is these portions which are actually exposed to the interior of the ducts.

The bottom wall of each duct is provided by the upper surface of a ceramic tile 60. One edge of each tile 60 is located below the edge of a respective tile 55, and the other edge of each tile 60 is received in a recess 61 in the wall 52 of a wear part carrier, the recess 61 being located directly below the recess 52.

An annular cover ring 70 is mounted on the top of the impeller and a pair of bolts 71*a* and 71*b* pass through the shafts 57*a* and 57*b* respectively of each wear part carrier 50, the lower end of each bolt being received in a threaded bore 72 in the baseplate 30. In addition, two clamp plates 73 are provided, the radially inner end of each clamp plate extending over an edge portion of the ring 20 and the radially outer portion of each clamp plate having an aperture 74 through which passes a bolt which then passes through the cylindrical shaft 57*c* of the wear part carrier below it, through the baseplate 30 and into a turntable (not shown) on which the impeller is mounted for rotation. The turntable is driven by a suitable motor, for example a diesel engine or an electric motor. The bolts 71*a* and 71*b* and the bolts which pass the apertures 74 ensure between them that the impeller rotates with the turn table as a unit, i.e. that is no relative rotation between the various components. The ceramic tiles 55 are held in their respective recesses 54 by an adhesive applied to the rear face. The tiles 58 and 60 may be similarly adhered to the cover plate 70 and base plate 30. However, such adhesive is not essential and one can rely simply on the fact that these tiles are trapped in place by the surrounding components.

Before proceeding to further consideration of the way in which the present invention operates one further constructional feature which may be mentioned here is that in each of the wear part carriers 50 the outer surface of the curved wall 50 is provided over a region adjacent its junction with the straight wall 52 with a wear-resistant face portion which is denoted by 51*a*. The reason for this is that comminuted material may build up in the region between the impeller and the anvils and that as the impeller rotates it may, in effect, have to cut through this built up comminuted material. The region which bears the brunt of this cutting out action is the region 51*a*.

Some characteristics of the operation of the present invention will now be described with reference to FIG. 7 which shows diagrammatically two of the six ducts 40. Some of the dimensions are indicated on the drawing by references a to e.

In FIG. 7:

O is the center of rotation of the impeller;

X is an arrow representing the direction of rotation of the impeller;

Y are arrows representing the directions in which material leaves the ducts;

a is the distance by which the wall 52 (defining the side of the duct which the forward wall as considered with reference to the direction of rotation of the impeller) extends beyond the tile 55 (defining the other side of the duct);

b is the width of the duct;

c is the length of the wall 52 minus a;

d is the diameter of the impeller measured to the radially outer end of the wall 52; and e is the radial distance from 0 to the radially inner end of the wall 52.

In a particular embodiment, d is 600 mm.

Consider by way of example a piece of material to be comminuted which travels radially outwardly from the center of rotation O of the impeller towards one of the ducts with a constant radial velocity. If one considers the movement of the piece of material from the point of view of the frame of reference of the duct, i.e. one treats the duct as stationary and only the material as moving, it will be apparent that the piece of material must move towards the tile 55 along a curved path which is at least approximately that of a parabola. The range of angles within which the piece of material can strike the tile plate 55 depends on the values of the parameters a to e. In particular, the narrower the duct is made the more oblique is the maximum angle at which the piece of material can strike the tile 55, i.e. the further from an angle normal to the tile. This reduces the effect of the impact of the material against the tile and thus reduces the likelihood of the tile fracturing. Also, the narrower the duct the nearer to the radially inner end of the duct must the piece of material strike the tile. The linear velocity of the tile is of course lowest at its radially inner end, which means that the velocity of impact between the piece of material and the tile is lowest if the material strikes the wear plate near the radially inner end. This too helps to reduce the risk of fracture.

The following table sets out the presently preferred ranges of various ratios of the various parameters a to e. These values relate to the use of a ceramic tile 55 made of 95% density aluminium oxide formed by cold pressing and sintering. The significance of the parameter a is that there is a risk of material bouncing back from the anvils and hitting the ceramic tiles. The presence of a substantial value for provides, in effect, a shield to reduce the likelihood of this happening.

It is to be understood that although the top and bottom walls of the ducts are also subject to a certain amount of wear, and for this reason are lined with ceramic tiles, the amount of wear there is significantly less than the wear to which the tile 55 is subjected. The side wall of each duct opposite its respective tile 55 is not particularly significant and no ceramic lining is required. It is sufficient that the wall should be of a reasonably abrasion resistant metal.

TABLE

| Ratio | Max | min. |
|---|---|---|
| a/b | 0.67 | 0.4 |
| b/d | 0.5 | 0.167 |
| c/d | 1.0 | 0.34 |
| e/d | 0.45 | 0.34 |

I claim:

1. A machine for cominuting material by impact, comprising:

a hollow impeller rotatable about a substantially vertical axis;

an upwardly opening material inlet and at least one radially outward material outlet duct; and at least one anvil arranged to be struck by material which has emerged from said duct; said duct being defined by a pair of side walls, a bottom wall and a top wall, and wherein at least the side wall which is rearward, as considered in the direction of rotation of the impeller, has a surface provided by a wear resistant tile, and the top and bottom duct walls each having a surface provided by respective wear resistant tiles, at least the wear resistant tile used for the rearward side wall being of ceramic material, said duct being sufficiently narrow to prevent material striking the side walls thereof with a high impact force.

2. A machine according to claim 1, wherein the ceramic material is selected from aluminium oxide and silicon carbide.

3. A machine according to claim 1, wherein a plurality of ducts is present, and the impeller comprises a plurality of carriers arranged in an annular array around the impeller, with each duct having one side wall thereof provided by a one carrier and the other side wall thereof provided by an adjacent carrier.

4. A machine according to claim 3, wherein each carrier has a wear-resistant surface portion adjacent the radially outer end of the forward side wall, as considered in the direction of rotation of the impeller.

5. A machine according to claim 1, wherein the value of b/d, where b is the width of the duct and d is the radius of the impeller measured to the radially outer end of the duct is from 0.167 and 0.5.

6. A machine according to claim 1, wherein the value of e/d, where e is the radial distance from the center of rotation of the impeller to the radially inner end of the duct and d is the radius of the impeller measured to the radially outer end of the duct, is from 0.34 to 0.45.

7. A machine according to claim 1, wherein the value of a/b, where a is the distance by which the forward wall of the duct extends beyond the rearward wall and b is the width of the duct, is from 0.4 to 0.67.

8. A machine according to claim 1, wherein the value of c/d, wherein c is the length of the side wall of the duct minus a, a being the distance by which the forward wall of the duct extends beyond the rearward wall, and d is the radius of the impeller measured to the radially outer end of the duct, is from 0.34 to 1.0.

* * * * *